United States Patent [19]

Joyce

[11] 3,983,603

[45] Oct. 5, 1976

[54] TIE FOR BUNDLING ITEMS

[75] Inventor: Arthur W. Joyce, Framingham, Mass.

[73] Assignee: Dennison Manufacturing Company, Framingham, Mass.

[22] Filed: Sept. 30, 1974

[21] Appl. No.: 510,219

[52] U.S. Cl. ..... 24/16 PB; 24/30.5 P; 264/235

[51] Int. Cl.[2] ..... F16L 33/00

[58] Field of Search ..... 24/16 PB, 30.5 P, 206 A, 24/17 B

[56] References Cited

UNITED STATES PATENTS

| | | | |
|---|---|---|---|
| 2,936,980 | 5/1960 | Rapata | 24/206 A |
| 3,102,311 | 9/1963 | Martin | 24/30.5 P |
| 3,106,028 | 10/1963 | Baumgartner | 24/16 PB |
| 3,463,427 | 8/1969 | Fisher | 24/16 PB |
| 3,490,104 | 1/1970 | Kabel | 24/16 PB |
| 3,735,448 | 5/1973 | Waddington | 24/16 PB |
| 3,747,164 | 7/1973 | Fortsch | 24/16 PB |
| 3,837,047 | 9/1974 | Bunnell | 24/16 PB |
| 3,872,547 | 3/1975 | Caveney | 24/16 PB |

FOREIGN PATENTS OR APPLICATIONS

| | | | |
|---|---|---|---|
| 1,573,303 | 7/1969 | France | 24/16 PB |

*Primary Examiner*—Bernard A. Gelak
*Attorney, Agent, or Firm*—Donald Brown

[57] ABSTRACT

A tie or harness for bundling items and having a strap with a tip having guide means to aid in the entry of the strap into a channel of the head of the harness, the guide means also preventing wrong way insertion of the strap into the head as well as providing means for firmly holding a blank used to form the strap tie in order to stretch same.

1 Claim, 9 Drawing Figures

TIE FOR BUNDLING ITEMS

BACKGROUND OF THE DISCLOSURE

This invention is directed to a method, and a blank for forming a tie or harness as well as a new and improved tie or harness for bundling items or articles such as wire and cable.

In particular the present invention is an improvement for a tie which comprises a locking head having a channel therethrough with a rigid projection which acts as a stop member and which extends into the channel and a strap for entering the channel.

In the aforementioned tie the strap used therein did not include means for aiding in the initial entry of the strap into the channel and thus threading of the strap was often difficult.

Additionally the aforementioned tie did not include any means for preventing wrong way entry of the strap into the head.

In addition the aforementioned strap was difficult to stretch because there was no way of grabbing onto the strap to stretch same without distorting the strap with pins or clamps.

The present invention provides a new and improved strap which overcomes the aforementioned difficulties and which has a tip with guide means which aids in the guiding or threading of the strap into the channel.

The guide means of this invention also prevents wrong way insertion of the strap into the channel of the head.

This invention also facilitates stretching of a blank for forming the tie without distortion of same by providing stretch grabbing means (which ultimately serve as the tip guide means) by which the strap can be securely held to permanently stretch the strap so as to strengthen portions thereof.

Reference may be had to U.S. Pat. No. 3,766,608 as well as to the art cited in this patent to familiarize oneself with typical harnessing devices of the prior art.

SUMMARY OF THE DISCLOSURE

The present invention provides a tie which comprises a head having a channel with a projection extending into the channel and a strap, the tie having an improved tip which includes guide means to permit easy entrance of the strap tip into the channel as well as preventing wrong way entry of the tip into the channel of the head.

The present invention also includes a new and improved method and blank for forming the tie, the method including the step of stretching the strap by engaging the guide means of the strap to facilitate holding of the strap while stretching portions thereof.

DETAILED DESCRIPTION OF THE DISCLOSURE

Figure 1:
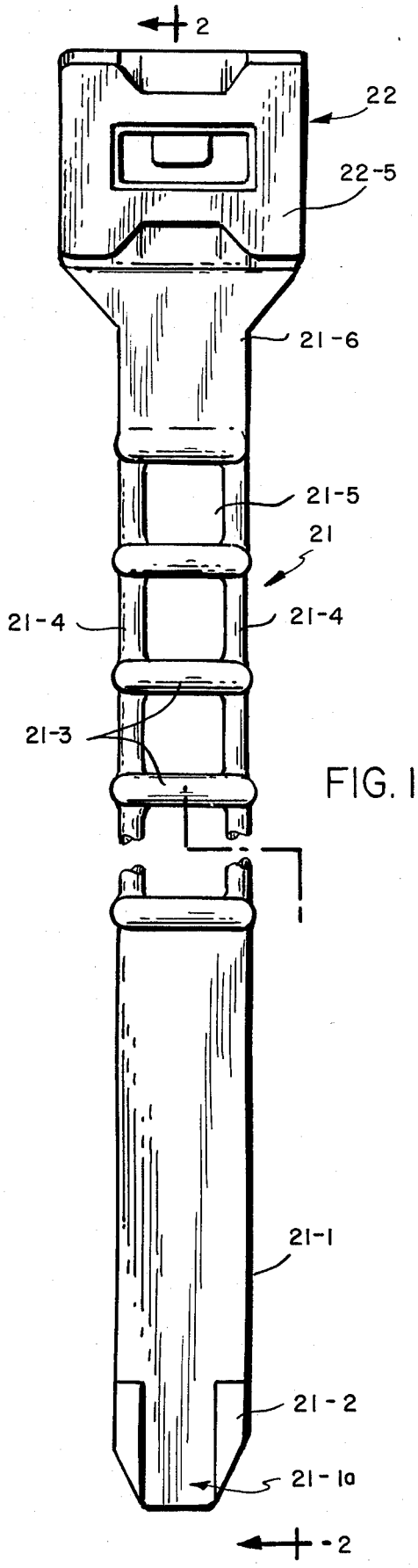
FIG. 1 is a top view of the tie of the invention illustrating the head and the strap including the tip of the invention.

Turning to the drawings, FIGS. 1 to 6 illustrate the preferred form of the tie or harness 20 of the invention. The tie 20 preferably comprises a strap 21 preferably attached to a locking head 22.

The strap 21 includes an insertion tip 21-1 and has at the front thereof guide runners or railings 21-2 to aid in the insertion of the strap into the tortuous channel 22-1 of the head 22. The guide runners define a tip inserting guide channel 21-1*a*. The strap 22 also preferably includes a plurality of cross-members 21-3 such as rungs supported by rails or side members preferably constructed of segments 21-4 (as shown). The rails and rungs are coupled together as shown to provide apertures 21-5.

In the preferred embodiment the rungs as well as the rails are cylindrical in cross-section with the cross-section of the rungs being larger than the cross-section of the rails 21-4.

In the preferred form of the invention the tip 21 portion is less flexible than the rails so that it may be firmly held for threading into the channel 21-1 of the head.

The apertured portion of the strap is preferably coupled to the head by a solid portion 21-6. The head 22 comprises a channel 22-1 having an entry or mouth 22-1*a* and an exit or rear 22-1*b*. The channel 22-1 is defined by bottom member 22-3, top member 22-4, and side members 22-5. The bottom member includes a first strap guide surface 22-6 which is preferably flat and a second strap guide surface 22-7 which is preferably inclined and preferably includes a flat surface 22-7*a* and a curved surface 22-7*b* preferably in the shape of an arc.

The top member 22-4 includes a top strap guide surface 22-8. Extending downwardly from the top surface 22-8 and into the channel 22-1 is a rigid projection 22-9 for catching on the rear of the cross members 21-3 to prevent withdrawal of the strap in a direction opposite to the direction of the strap insertion into the mouth 22-1*a*.

Figure 2:
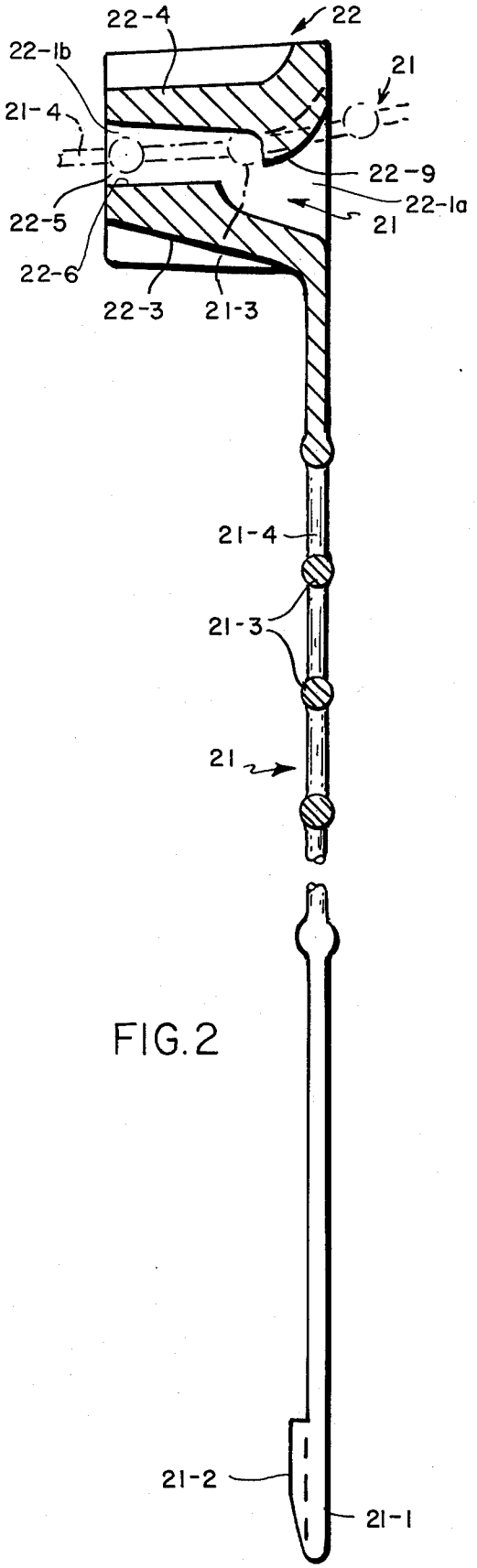
FIG. 2 is a sectional view taken along line 2—2 of FIG. 1.
Figure 3:
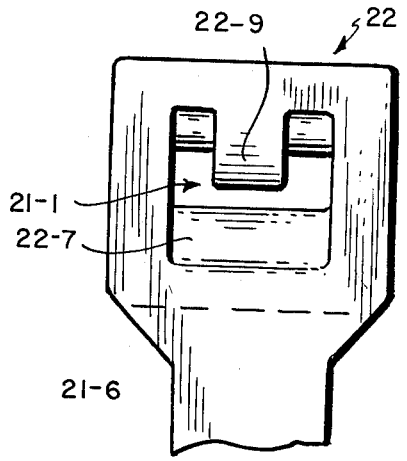
FIG. 3 is a view of the insertion side of the head shown in FIG. 2.

The projection 22-9 is preferably hook-shaped so that it may enter the apertures 21-5 as shown in FIG. 2 when the strap is pulled tight about the items e.g., cable and wire to be bundled.

The juncture of the surfaces 22-6 and 22-7 is as shown in the drawings a distance forward of the projection rear shoulder 22-9*b* so that upon passage of the strap into the channel 22-1 the strap 21 is directed forward of the projection 22-9 with the rung 21-3 positioning itself beyond the shoulder 22-9*b*.

In this configuration the runged portions of the strap cannot advance straight into the space forward of the projection but must take a tortuous path under and about the projection 22-9.

Figure 4:
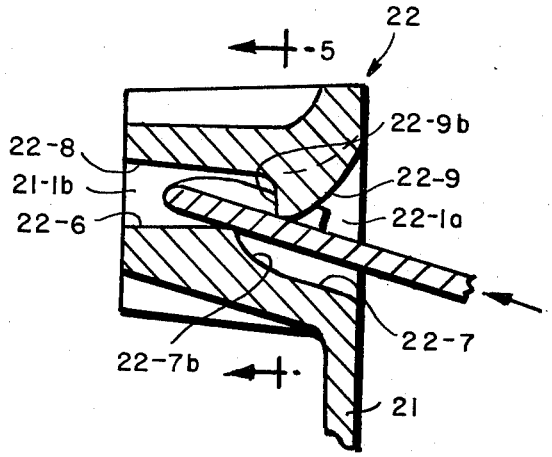
FIG. 4 is a sectional view similar to FIG. 2 illustrating the tip of the strap of the tie being pushed in the direction of the arrow into the channel of the head to bundle a plurality of wires.
Figure 5:
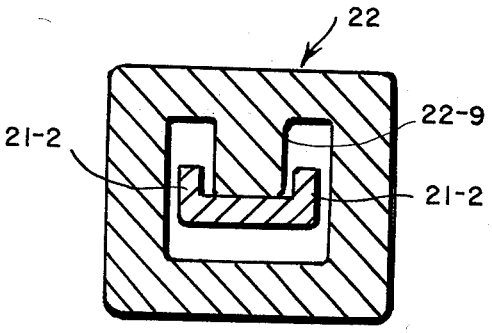
FIG. 5 is a sectional view taken along line 5—5 of FIG. 4.

FIGS. 4–5 of the drawing illustrate threading of the flexible strap tip into the head and in particular illustrate the strap being guided into the head with the aid of the guide runners 21-2.

It may be observed that the tip 21-1 passes under and about the rigid projection 22-9 upon entering the mouth 22-1*a*.

Figure 6:
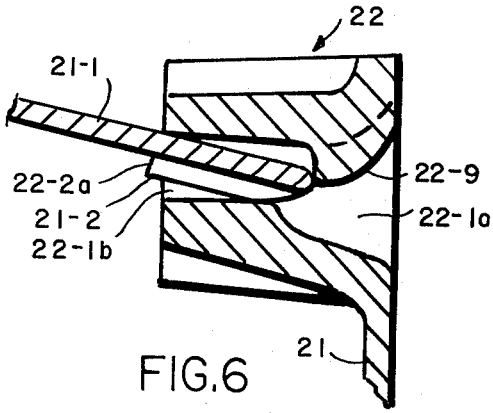
FIG. 6 illustrates in a view similar to FIG. 4 the attempt to insert a tip of the strap into the wrong end of the head.

FIG. 6 of the drawing illustrates the passage of the tip into the exit 22-1*b* (the wrong side of the head channel). As may be observed, the runners 21-2 raise the inverted tip 21-1 so that it engages the projection 22-9 whereby the tip cannot pass through the space between the projection 22-9 and the intersection of surfaces 22-6 and 22-7.

In this manner the strap 21 is prevented from being incorrectly threaded into the head 22.

Figure 7:
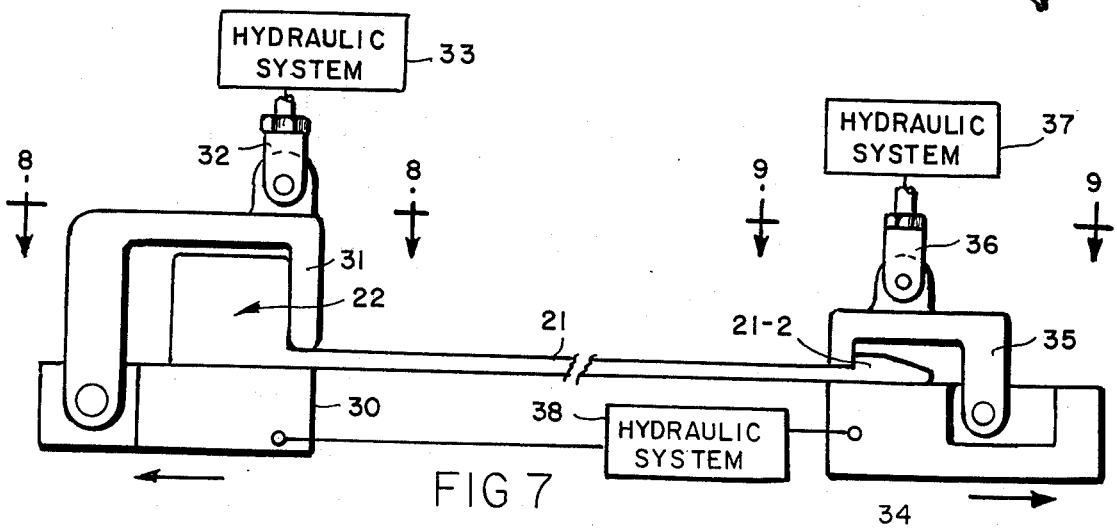
FIGS. 7–9 illustrate in side, and sectional views taken along lines 8—8 and 9—9 a tie blank and the method for forming the strap of this invention.
Figure 8:
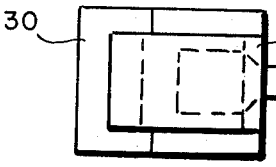
Figure 9:
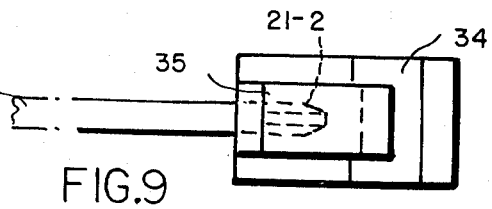

Reference should now be had to FIGS. 7–9 which illustrate the method and blank used in the method for forming the tie of FIGS. 1–6. The apparatus of FIGS. 7–9 is utilized when the strap is made of plastic material such as nylon which is permanently stretchable and which when stretched will increase in strength as in now well known in the art.

The blank comprises a head 22 and strap 21 supported by transport mechanism 20 and 34 which are movable in the directions shown by the arrows to produce a strap 21 having stretched portions, i.e., primarily stretched rail segments 21-4.

The transport mechanism 30 comprises a clamp 31 which engages the head and strap as shown and is clamped against the strap by provision of coupling 32 and a conventional hydraulic cylinder system 33. The transport mechanism 34 comprises a clamp 35 which engages the strap tip 21-1 as shown and engages the shoulders or abutments 21-2*a* of the runner guides 21-2.

Clamping of the tip is effected by a coupling 36 connected to a conventional hydraulic cylinder system 37.

Prior to stretching the strap is preferably heated by the use of heat lamps to a temperature below the melting point of the nylon, e.g., 400° ± 50°F.

In order to stretch the strap, the transport mechanisms 30 and 34 are preferably mounted on rails (not shown) and are forced apart by use of a conventional hydraulic cylinder system 38 which moves the transport mechanisms 30 and 34 in the directions shown by the arrows thereby stretching the strap to strengthen it.

In practice a pressure of about 300 to 400 psi is applied to the strap in effecting stretching of same. It may thus be observed that a blank has been provided which includes means for stretching the strap without distorting the tip thereof.

It should be understood that the strap and the head are of plastic material and may be of such diverse types such as polyetheyline, nylon, polypropylene, etc., depending upon the use to be made of same by the tie.

It should also be understood that the device of FIGS. 1–6 need not be stretched if the strength of the plastic is sufficient for the use intended without stretching.

I claim:

1. In a plastic tie blank having a head and a ladder strap coupled thereto, said strap having a pair of unstretched side members to be stretched to increase the strength thereof and a plurality of spaced apart rungs coupled between said side members, said tie having a tip forming the forward portion of the strap with a pair of spaced apart rails confined thereto and extending upwardly therefrom and having shoulder means at the rear thereof closest to said rungs, said shoulder means providing an abutment for permitting urging of said tip away from said head in order to stretch said side members and said rails also defining a guide channel.

* * * * *